US009894943B2

(12) United States Patent
Gehlen et al.

(10) Patent No.: US 9,894,943 B2
(45) Date of Patent: Feb. 20, 2018

(54) GARMENT WITH INTEGRATED SPEAKERS

(71) Applicants: Grant P. Gehlen, Eagan, MN (US); Steven A. Rose, Minneapolis, MN (US); Jaclyn M. Tejeda, Lincoln, NE (US)

(72) Inventors: Grant P. Gehlen, Eagan, MN (US); Steven A. Rose, Minneapolis, MN (US); Jaclyn M. Tejeda, Lincoln, NE (US)

( * ) Notice: Subject to any disclaimer, the term of this patent is extended or adjusted under 35 U.S.C. 154(b) by 0 days.

(21) Appl. No.: 15/076,171

(22) Filed: Mar. 21, 2016

(65) Prior Publication Data

US 2016/0270454 A1 Sep. 22, 2016

Related U.S. Application Data

(60) Provisional application No. 62/135,895, filed on Mar. 20, 2015.

(51) Int. Cl.

| | |
|---|---|
| ***A41D 13/00*** | (2006.01) |
| ***A41D 1/00*** | (2018.01) |
| ***H04R 1/02*** | (2006.01) |
| ***H04R 1/44*** | (2006.01) |

(52) U.S. Cl.

CPC ..... *A41D 1/005* (2013.01); *A41D 13/0015* (2013.01); *H04R 1/028* (2013.01); *H04R 1/44* (2013.01); *H04R 2201/023* (2013.01); *H04R 2201/028* (2013.01)

(58) Field of Classification Search

CPC .. A41D 13/0015; A41D 1/02; A41D 13/0012; A41D 13/012; A41D 3/00; A63B 71/12; G08B 17/06; H04R 5/023; H04R 5/02

USPC ..... 2/69, 461, 462, 93, 94, 82, 108; 340/586; 381/301, 333, 388, 364

See application file for complete search history.

(56) References Cited

U.S. PATENT DOCUMENTS

| | | | | |
|---|---|---|---|---|
| 2,285,083 | A | 6/1942 | Cover, Sr. | |
| 4,539,700 | A | 9/1985 | Sato | |
| 4,825,471 | A * | 5/1989 | Jennings | A41D 1/002 2/115 |
| 4,860,364 | A * | 8/1989 | Giannini | G10H 1/00 2/20 |
| 4,876,724 | A * | 10/1989 | Suzuki | H05K 11/00 2/250 |
| 5,326,297 | A | 7/1994 | Loughlin | |
| 5,563,951 | A * | 10/1996 | Wang | G02C 11/06 381/301 |
| 5,635,909 | A * | 6/1997 | Cole | A62B 17/003 2/93 |
| 7,023,338 | B1 | 4/2006 | Foth | |
| 7,035,422 | B1 | 4/2006 | Wiener | |
| 7,440,581 | B2 * | 10/2008 | Wiener | H04R 5/023 381/301 |
| 8,834,222 | B2 * | 9/2014 | Ewing | B63C 9/11 441/106 |
| 2006/0099864 | A1 | 5/2006 | Crumrine et al. | |
| 2008/0267440 | A1 | 10/2008 | Alden | |
| 2009/0311928 | A1 | 12/2009 | McClintock et al. | |

(Continued)

*Primary Examiner* — Tejash Patel
(74) *Attorney, Agent, or Firm* — Merchant & Gould P.C.

(57) ABSTRACT

The present disclosure provides a garment that includes integrated waterproof impact resistant speakers. Related methods of manufacturing the garment are also provided herein.

17 Claims, 17 Drawing Sheets

(56) References Cited

U.S. PATENT DOCUMENTS

| | | | | |
|---|---|---|---|---|
| 2011/0019861 | A1 | 1/2011 | Wolfe | |
| 2013/0279729 | A1* | 10/2013 | Richards | H04R 5/023 381/333 |

* cited by examiner

GARMENT WITH INTEGRATED SPEAKERS

This application is a utility application, which claims the benefit of provisional application Ser. No. 62/135,895 filed Mar. 20, 2015, which is incorporated herein by reference in its entirety.

TECHNICAL FIELD

The present disclosure provides a garment having integrated speakers and related methods of manufacturing the same.

BACKGROUND

Garments are worn in a number of different potentially wet and rugged environments. For example, buoyant vests are commonly worn by wakeboarders, water skiers, and kite boarders. During such water activities it is often desirable to play music. However, to provide music to the athlete during wakeboarding or water skiing, the volume of the music must be very high in part due to the relatively large distance between the athlete and the tow boat. Headphones are not ideal for use in these types of environments as they can be lost and/or cause injury to the athlete when the athlete impacts the water. There is a need in the art for garments having integrated waterproof impact resistant speakers.

SUMMARY

The present disclosure provides a garment that includes integrated waterproof impact resistant speakers. Related methods of manufacturing the garment are also provided herein.

DETAILED DESCRIPTION

Figure 1:
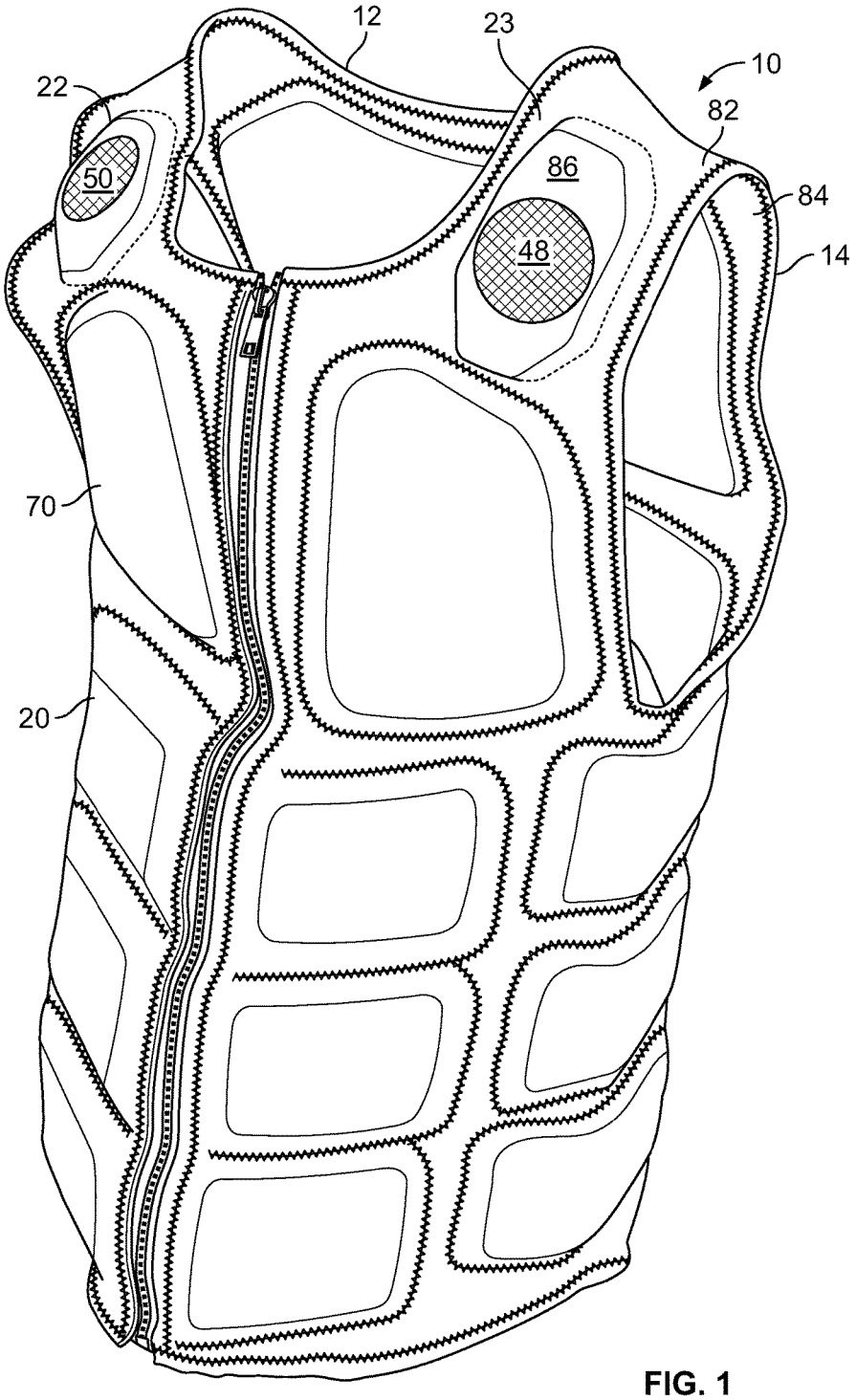
FIG. 1 is a front perspective view of a garment according to an embodiment of the present disclosure.
Figure 2:
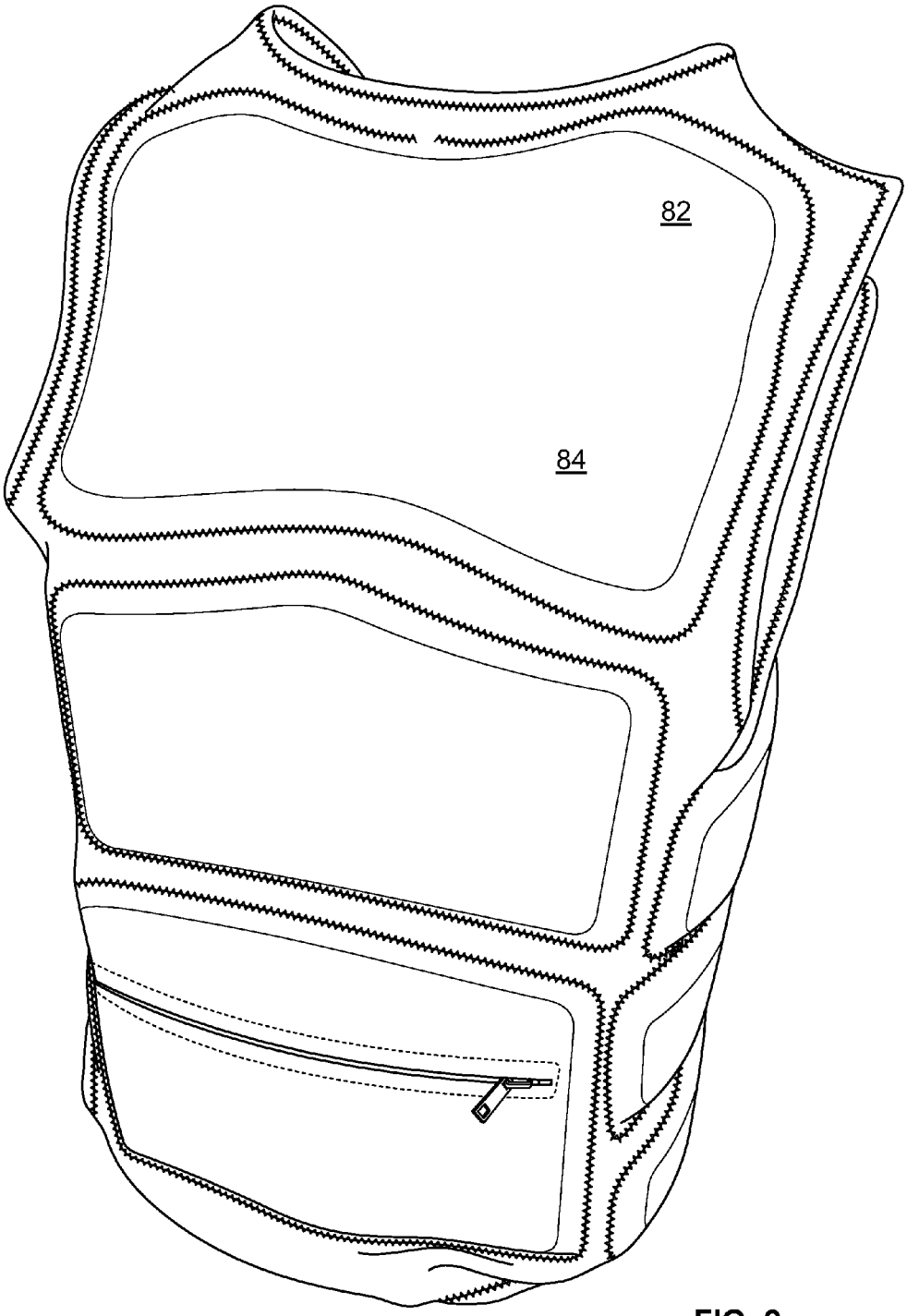
FIG. 2 is a rear perspective view of the garment of FIG. 1.
Figure 3:
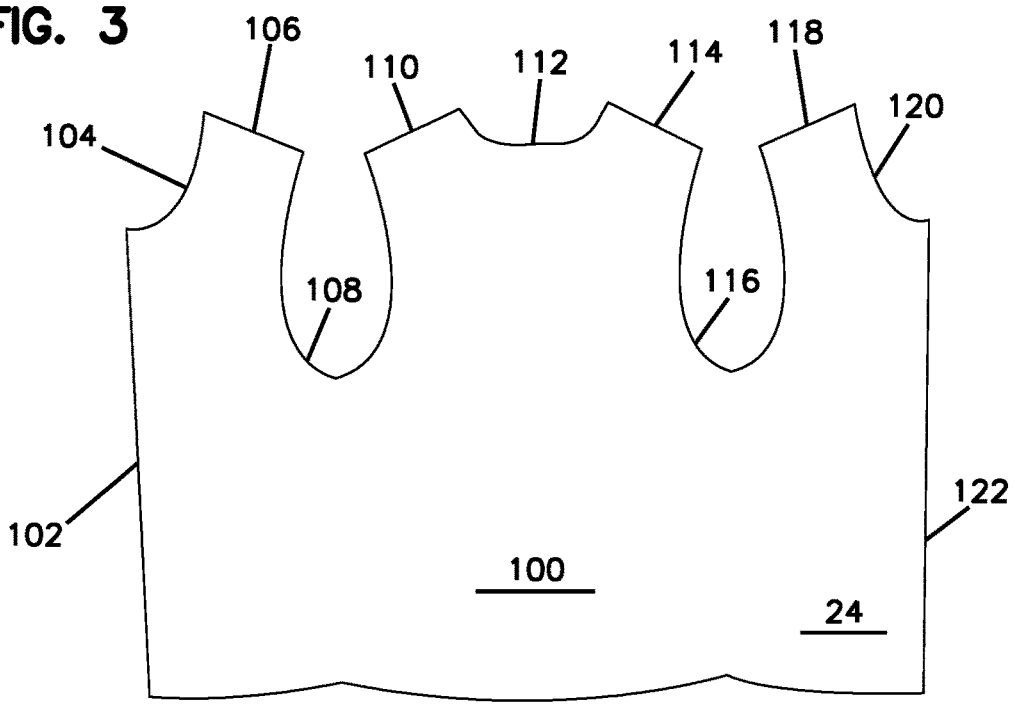
FIG. 3 is a partially assembled view of the garment of FIG. 1.
Figure 3:
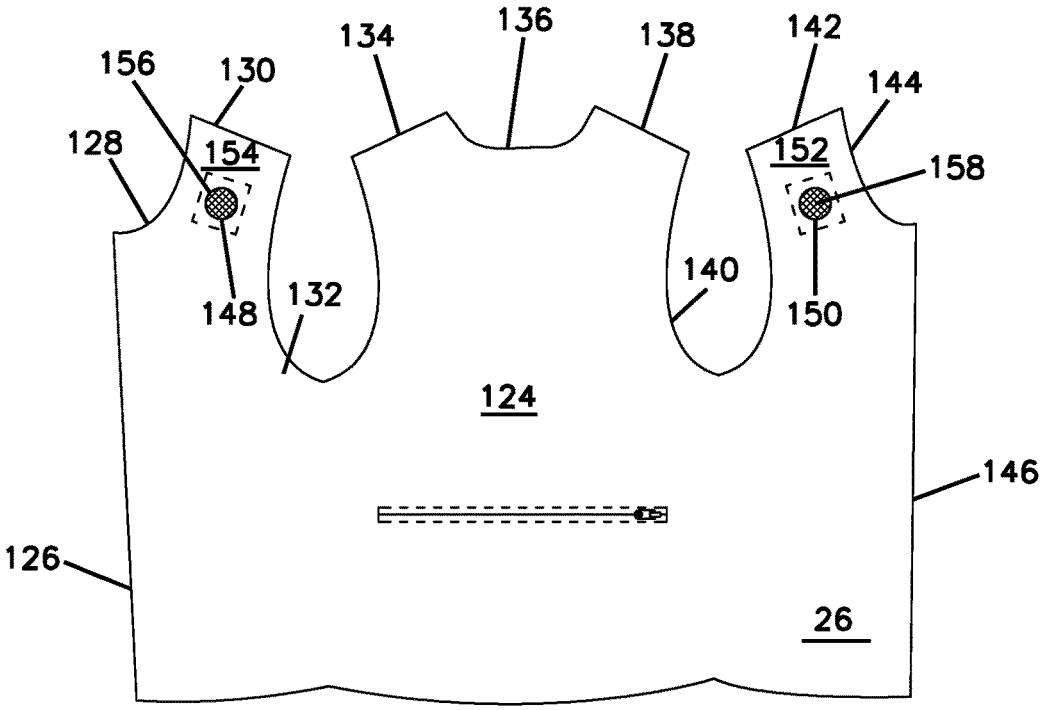
Figure 4:
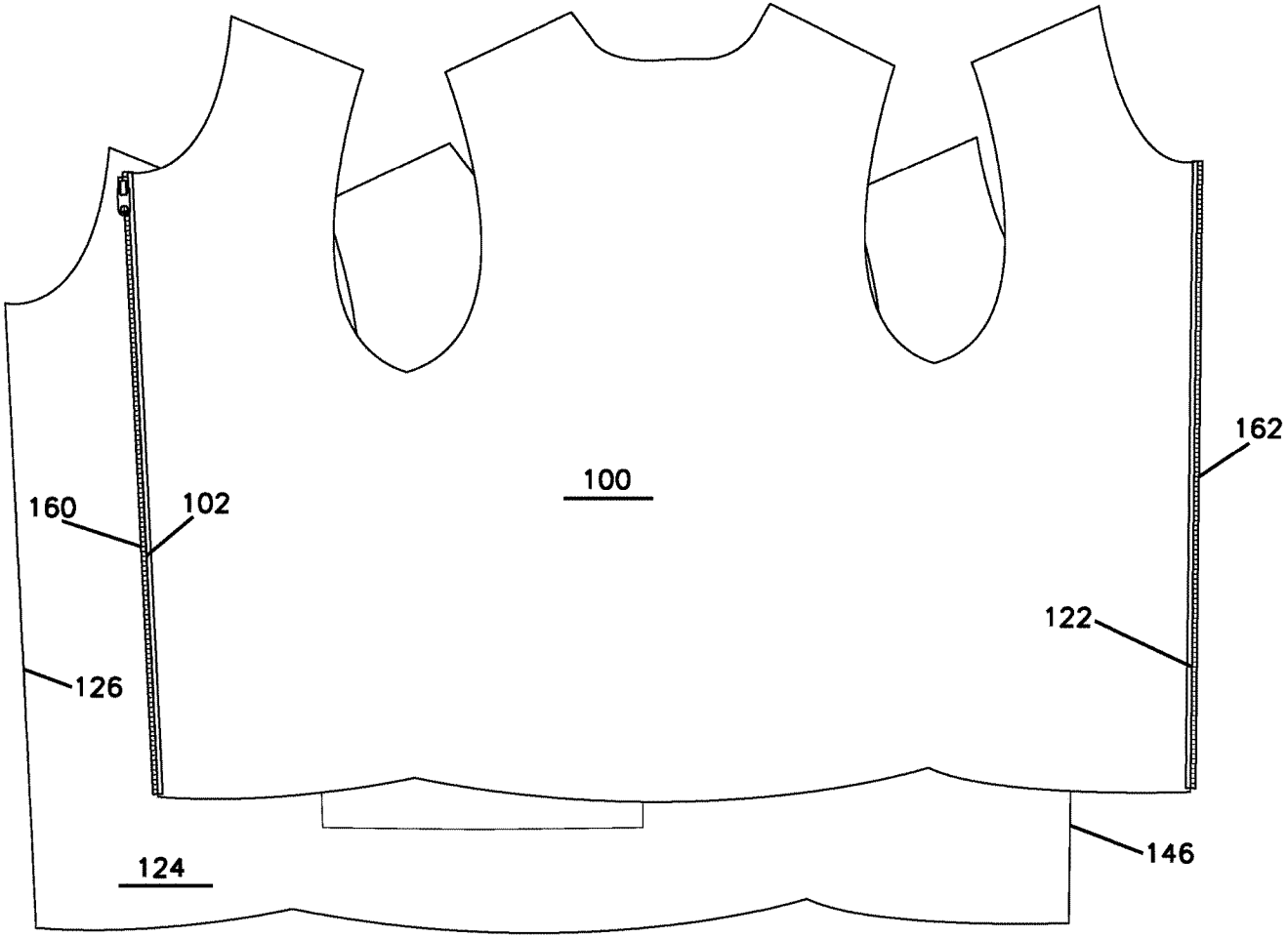
FIG. 4 is a partially assembled view of the garment of FIG. 1.
Figure 5:
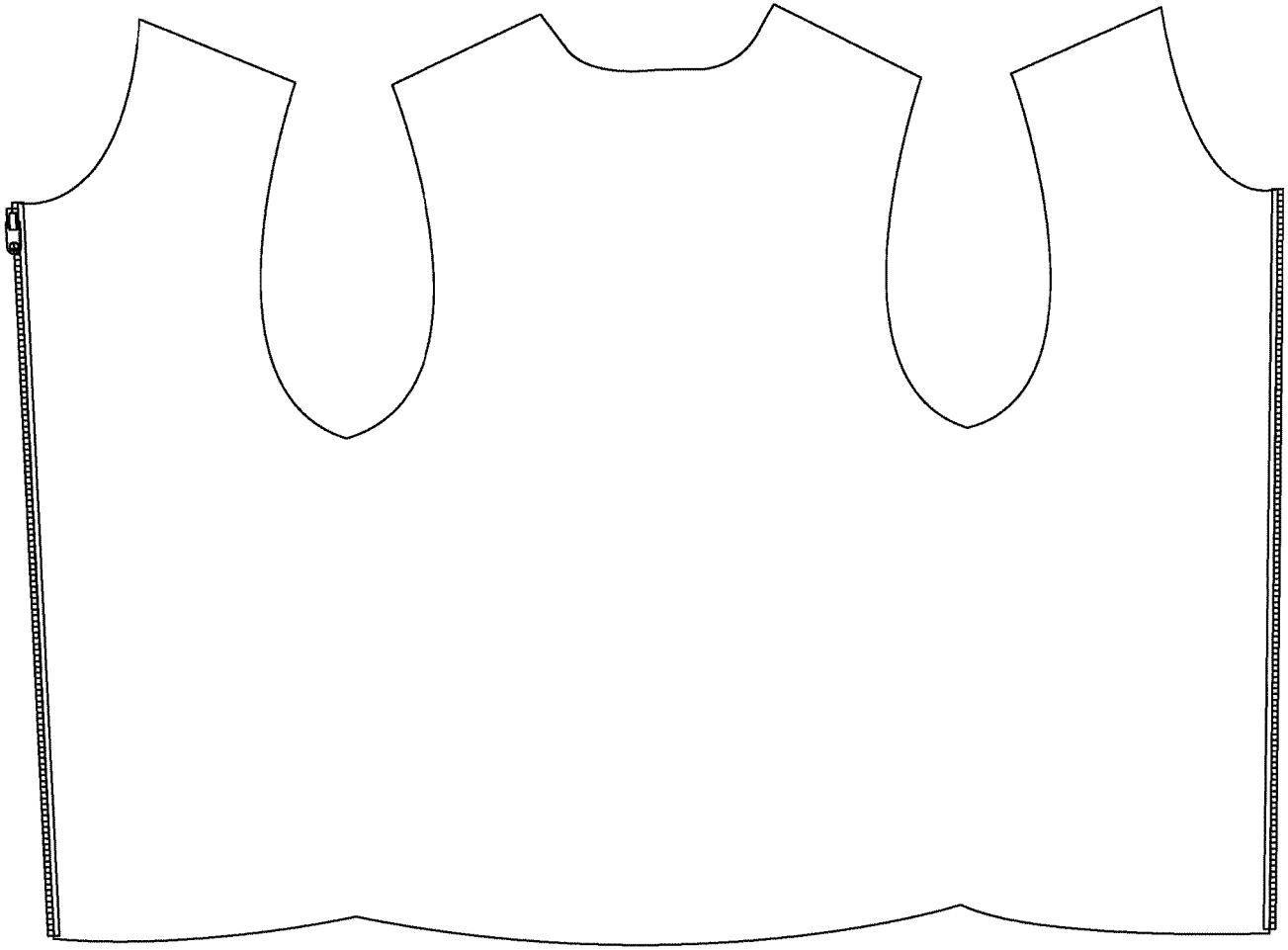
FIG. 5 is a partially assembled view of the garment of FIG. 1.
Figure 6:
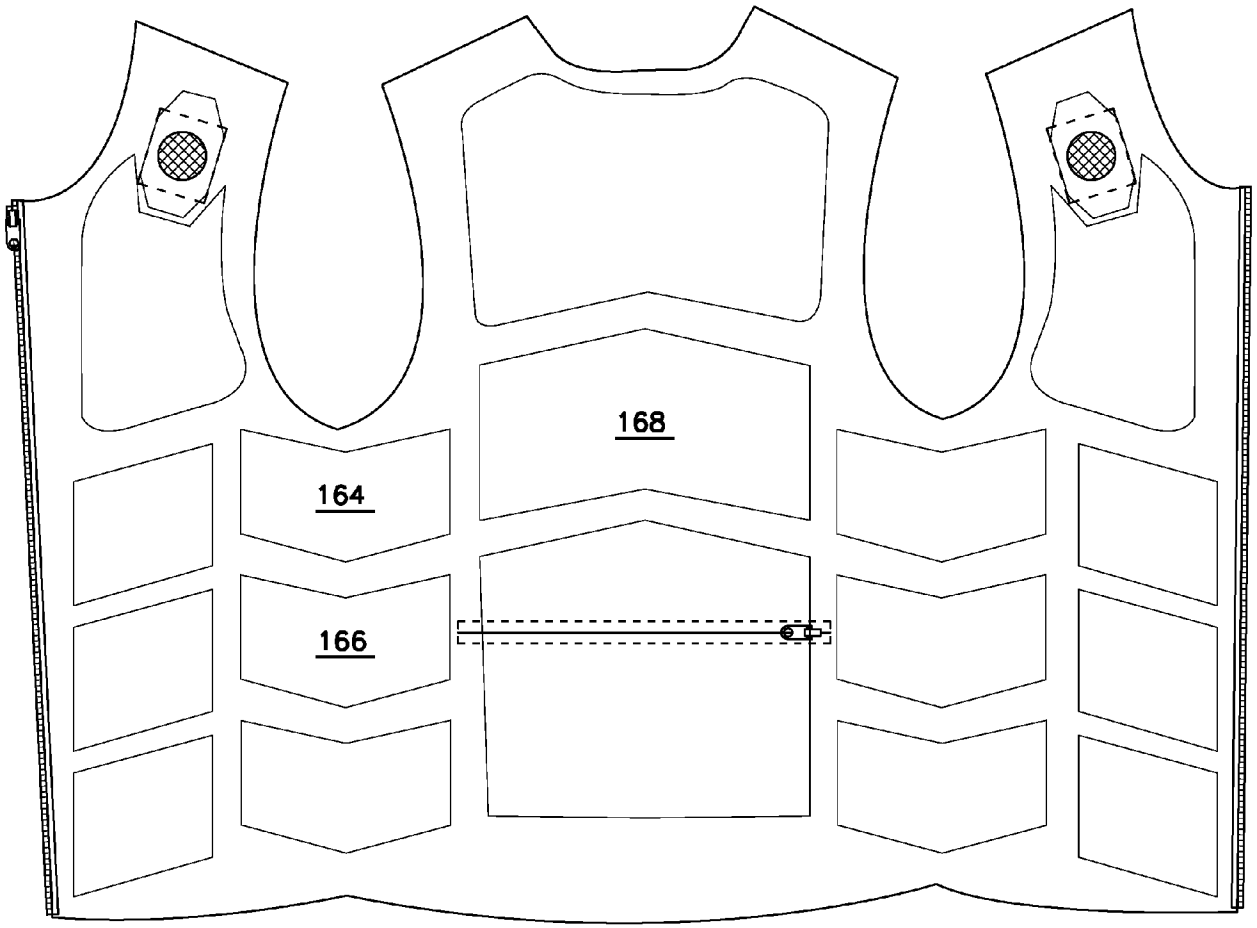
FIG. 6 is a partially assembled view of the garment of FIG. 1.
Figure 7:
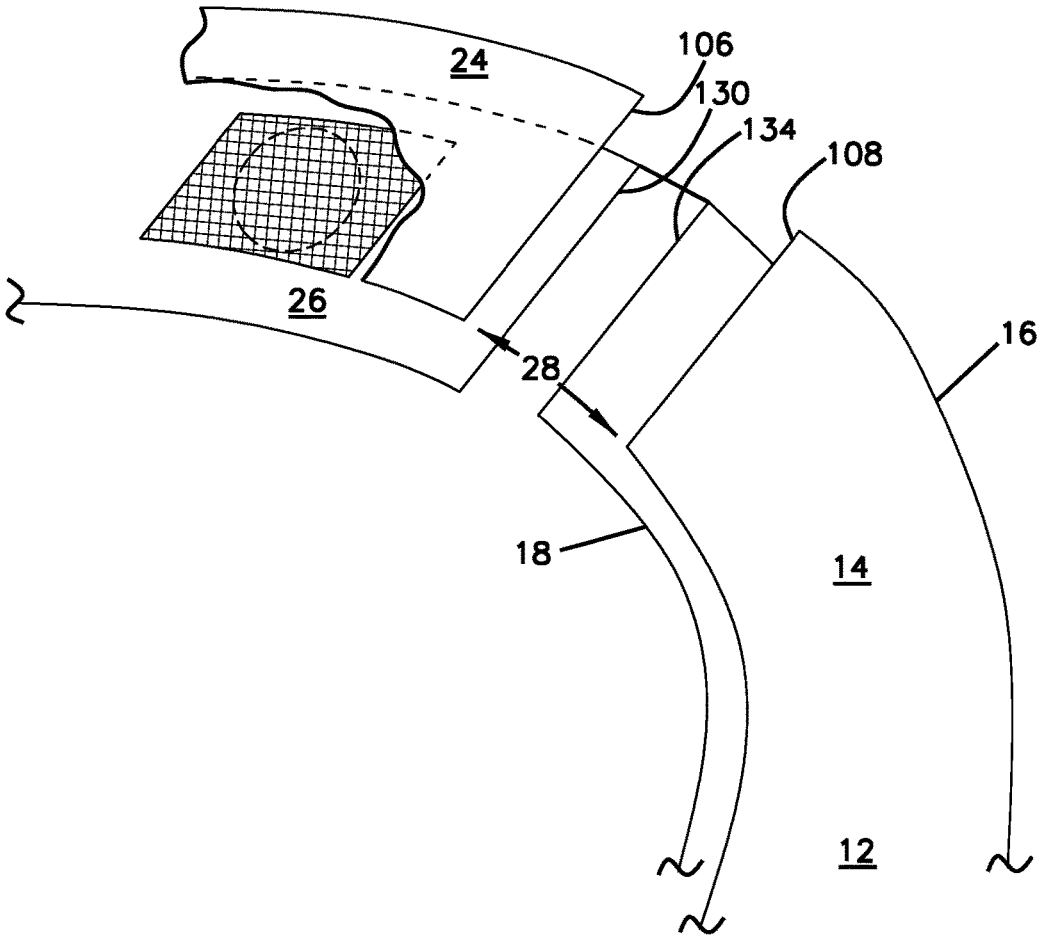
FIG. 7 is a partially assembled view of the garment of FIG. 1.
Figure 8:
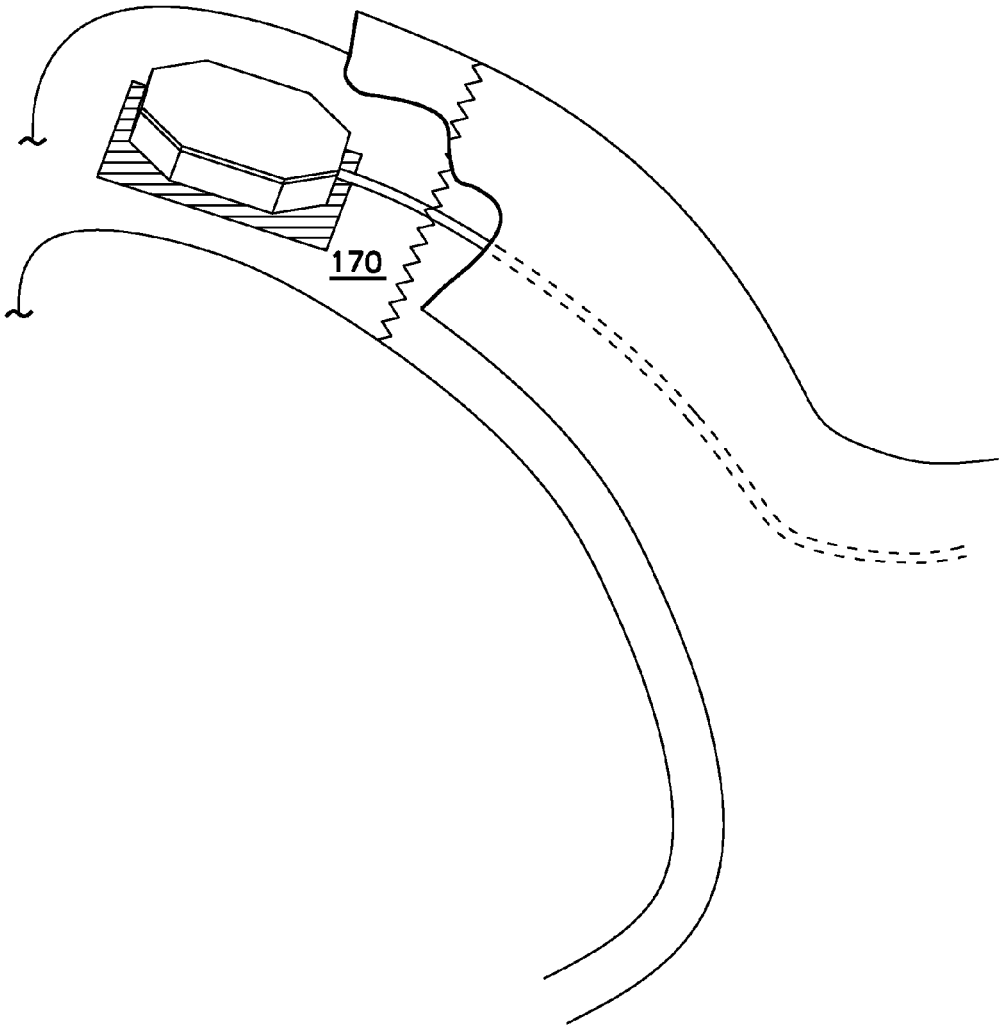
FIG. 8 is a partially assembled view of the garment of FIG. 1.
Figure 9:
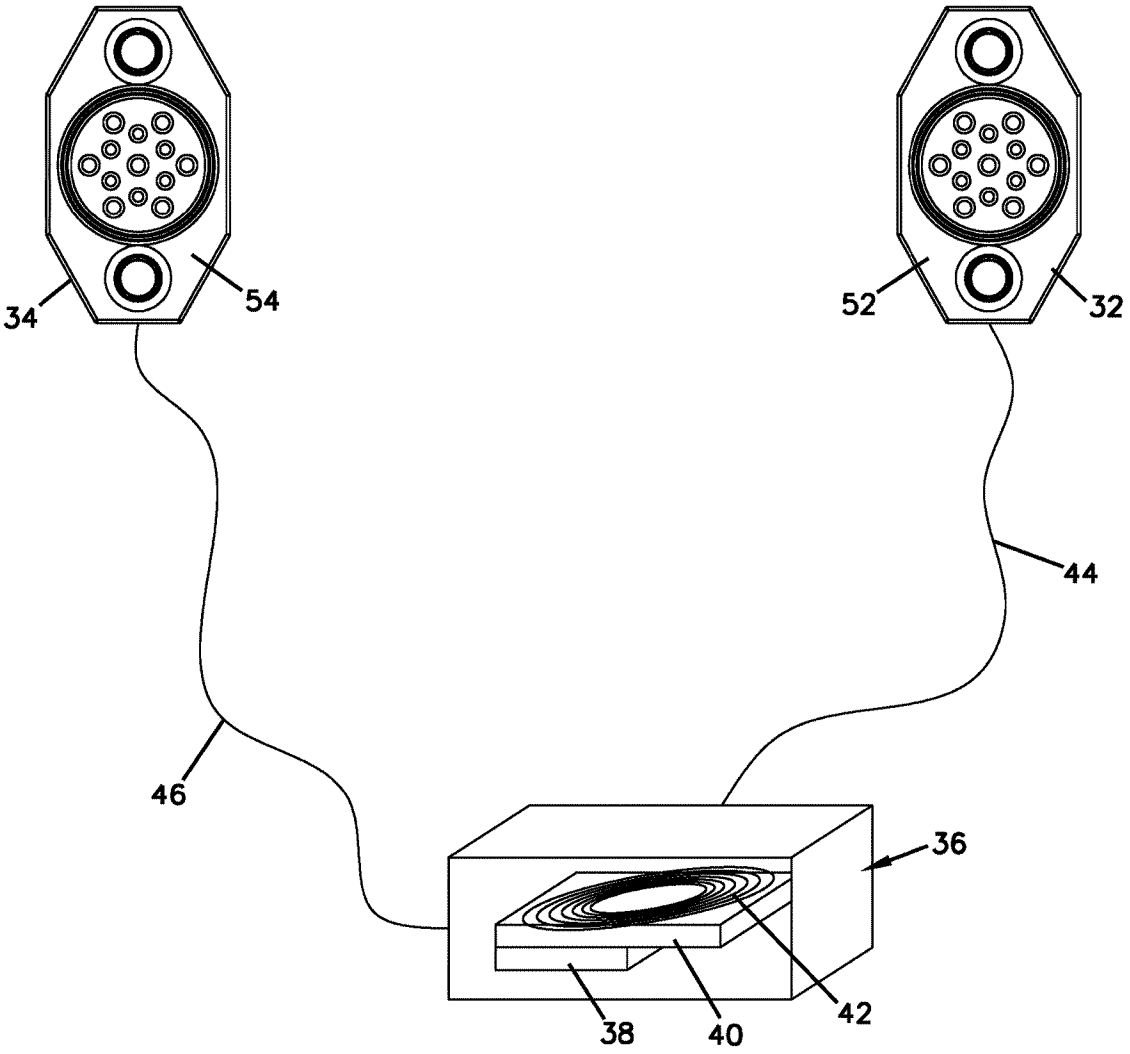
FIG. 9 is a partially assembled view of certain electrical components of garment of FIG. 1.
Figure 10:
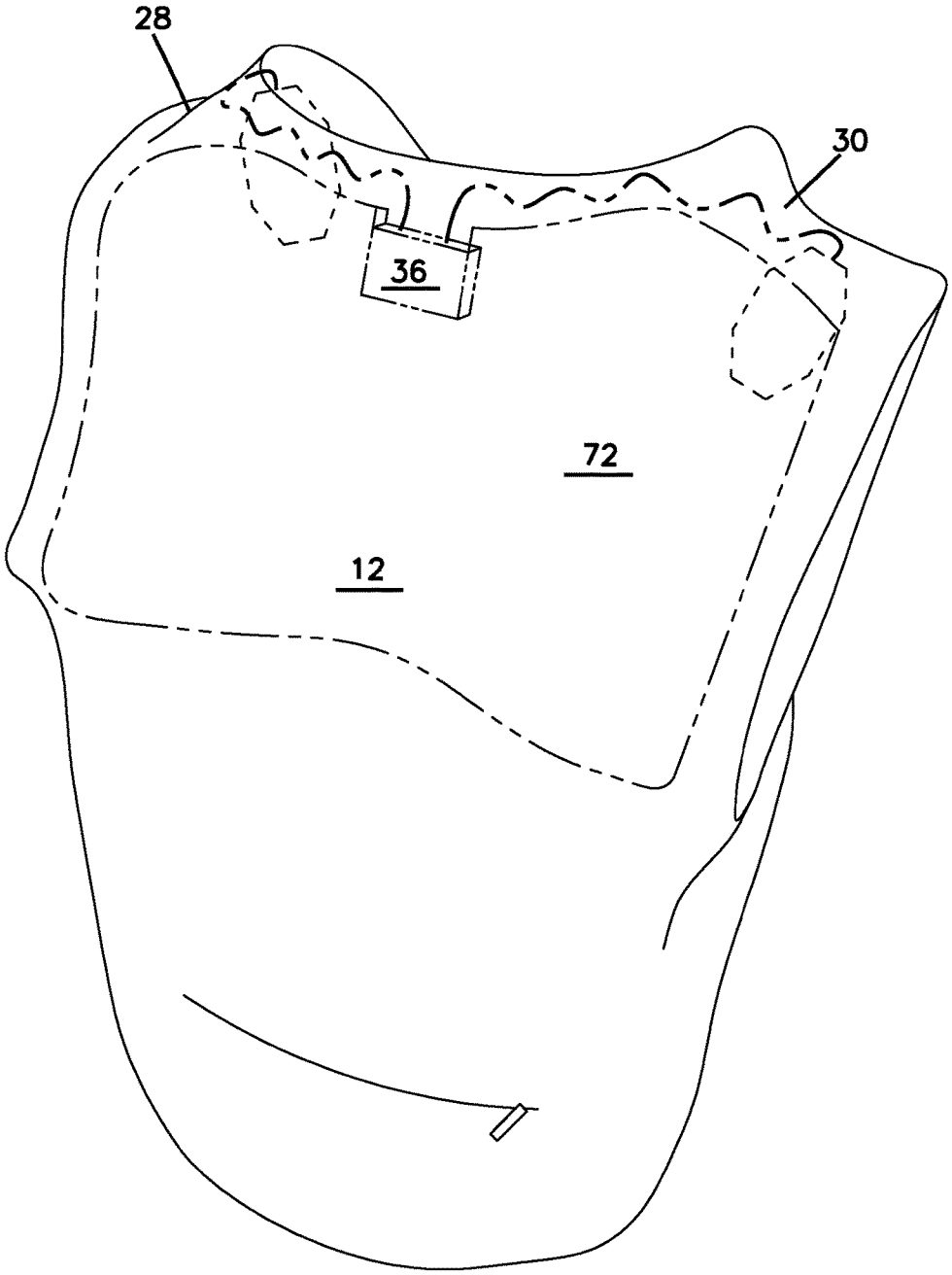
FIG. 10 is a partially assembled view of the garment of FIG. 1 with the components of FIG. 9 integrated therein.
Figure 11:
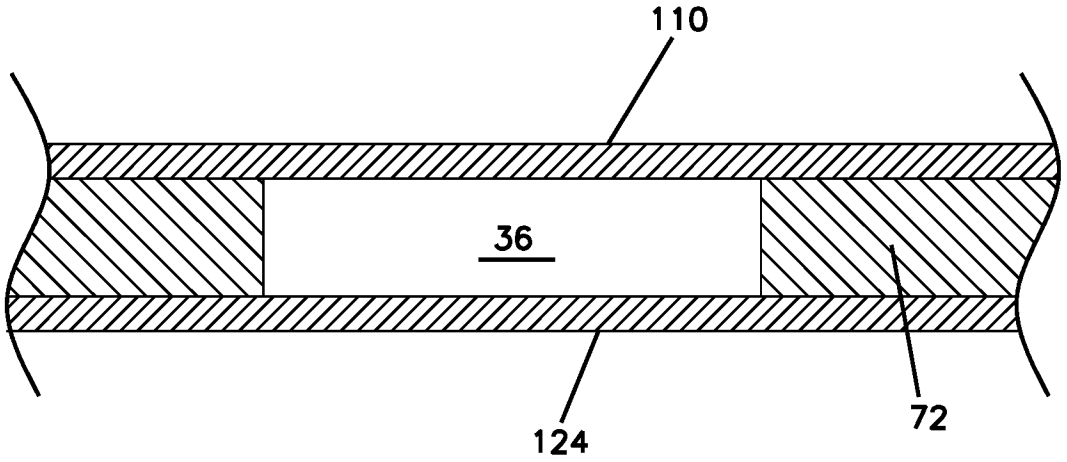
FIG. 11 is a cross sectional view of a rear portion of the garment of FIG. 1.
Figure 12:
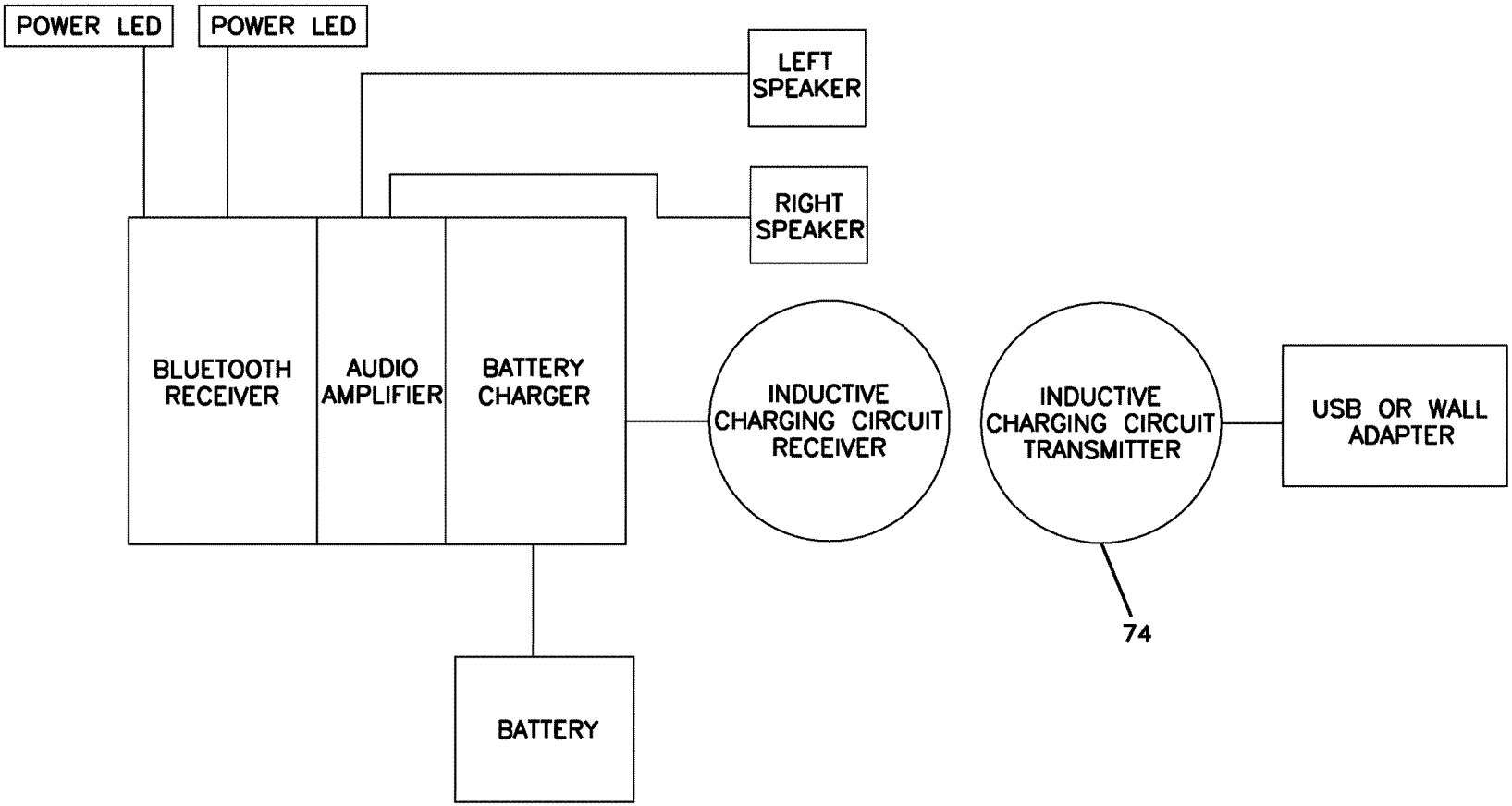
FIG. 12 is a block diagram of the electrical components of FIG. 9.
Figure 13:
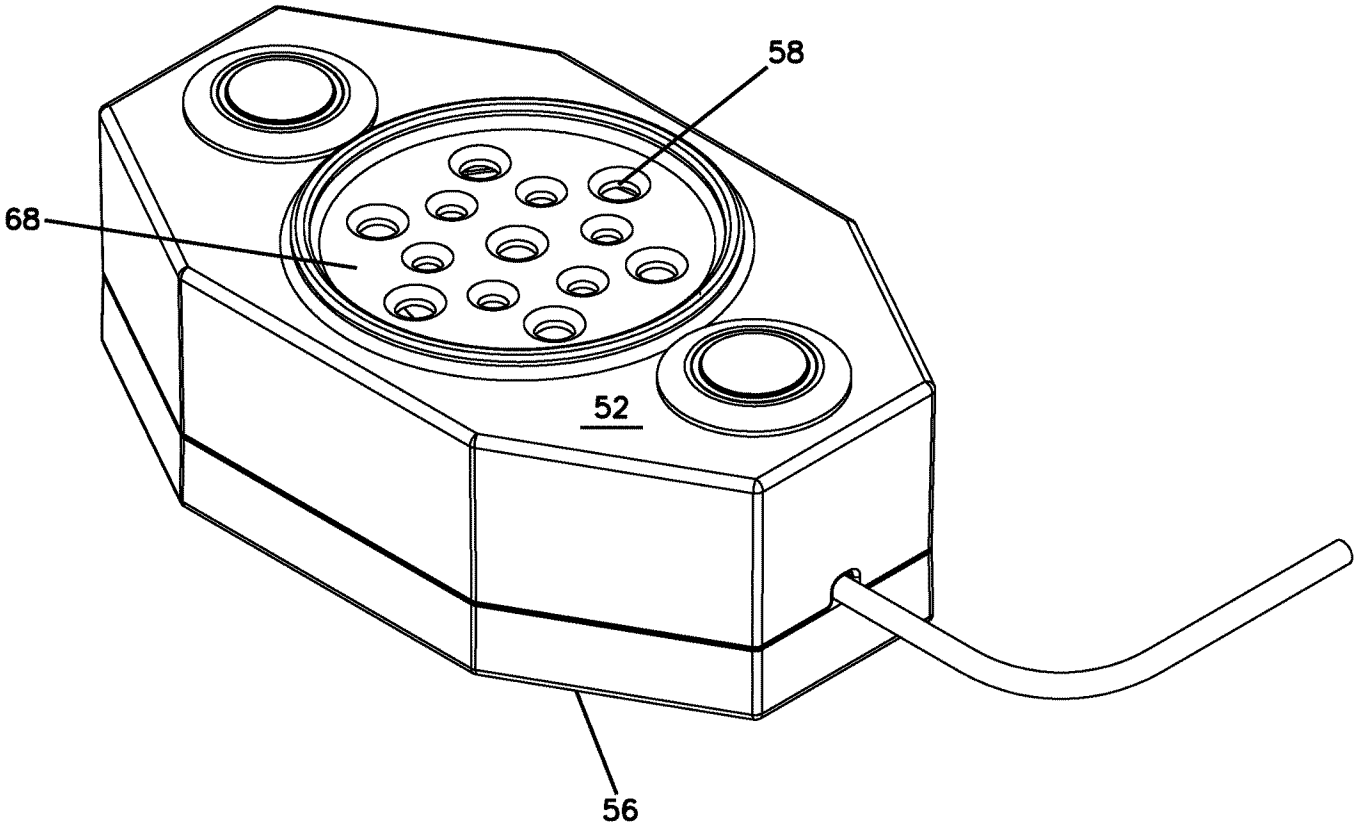
FIG. 13 is a perspective view of a component of the garment of FIG. 1.
Figure 14:
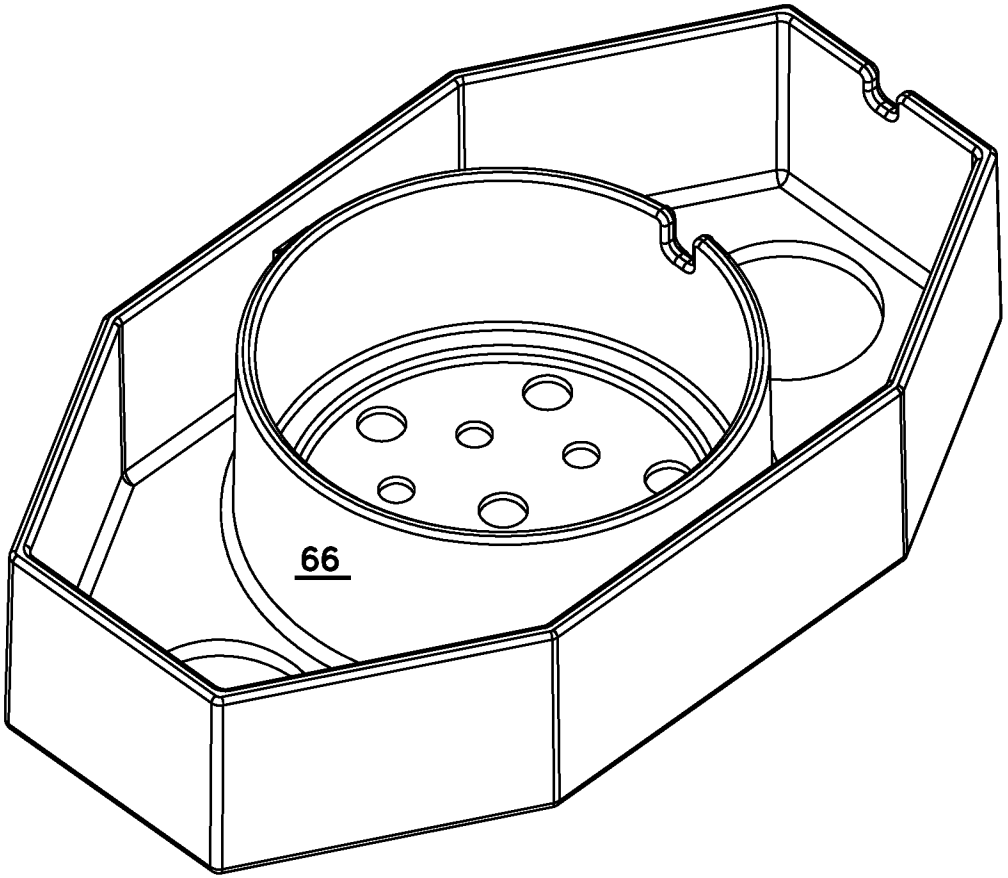
FIG. 14 is a cross sectional view of the component of FIG. 13.
Figure 15:
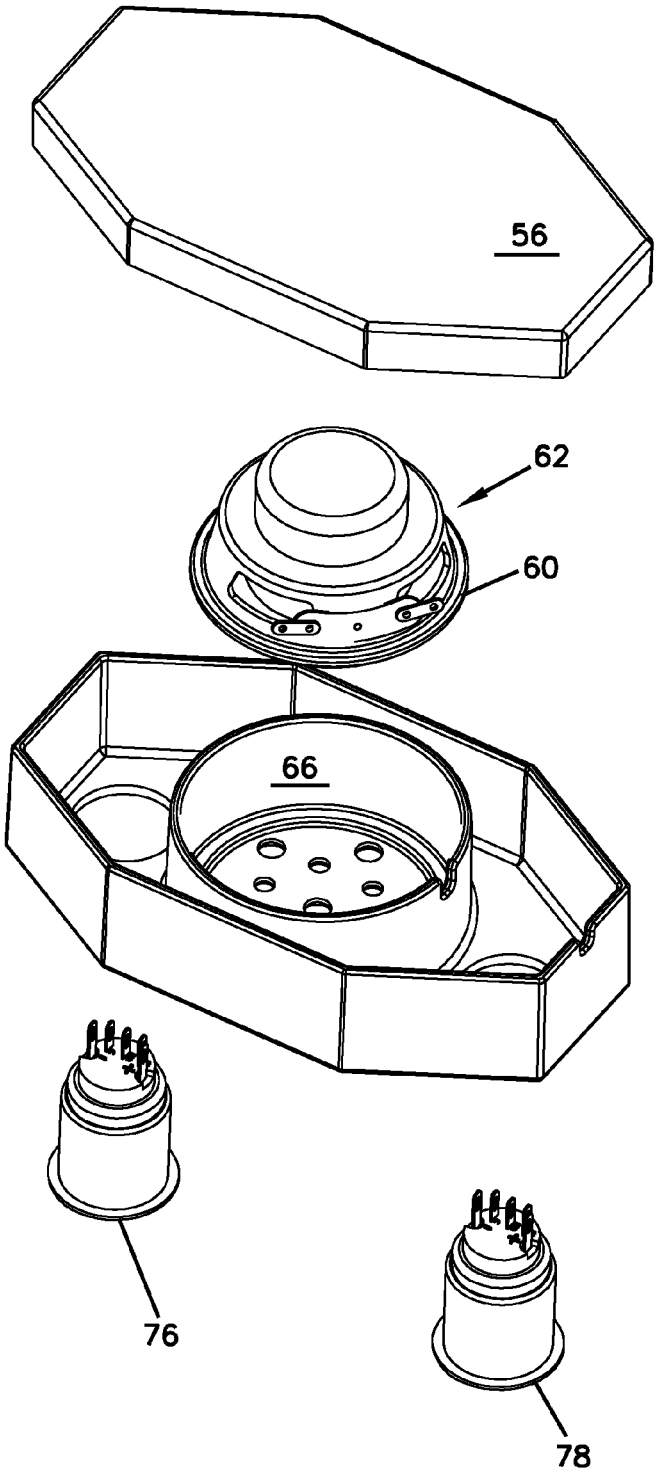
FIG. 15 is a perspective exploded view of the component of FIG. 13.
Figure 16:
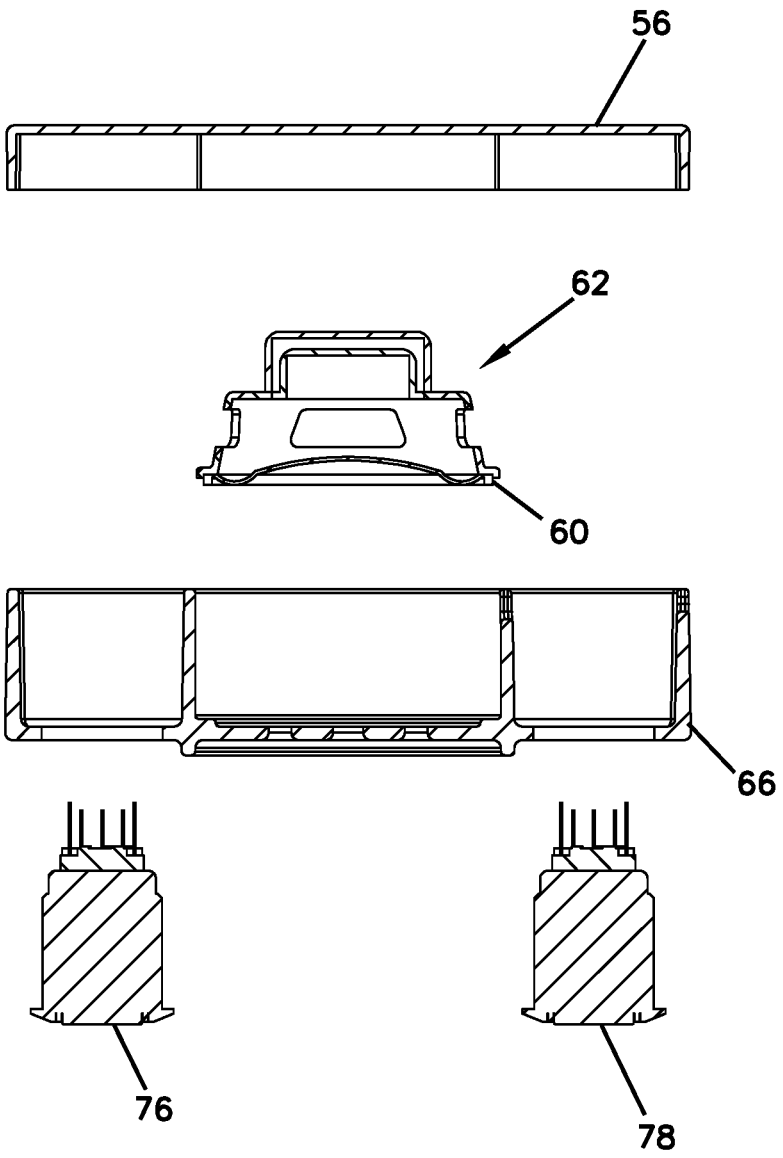
FIG. 16 is a perspective exploded view of the component of FIG. 13.
Figure 17:
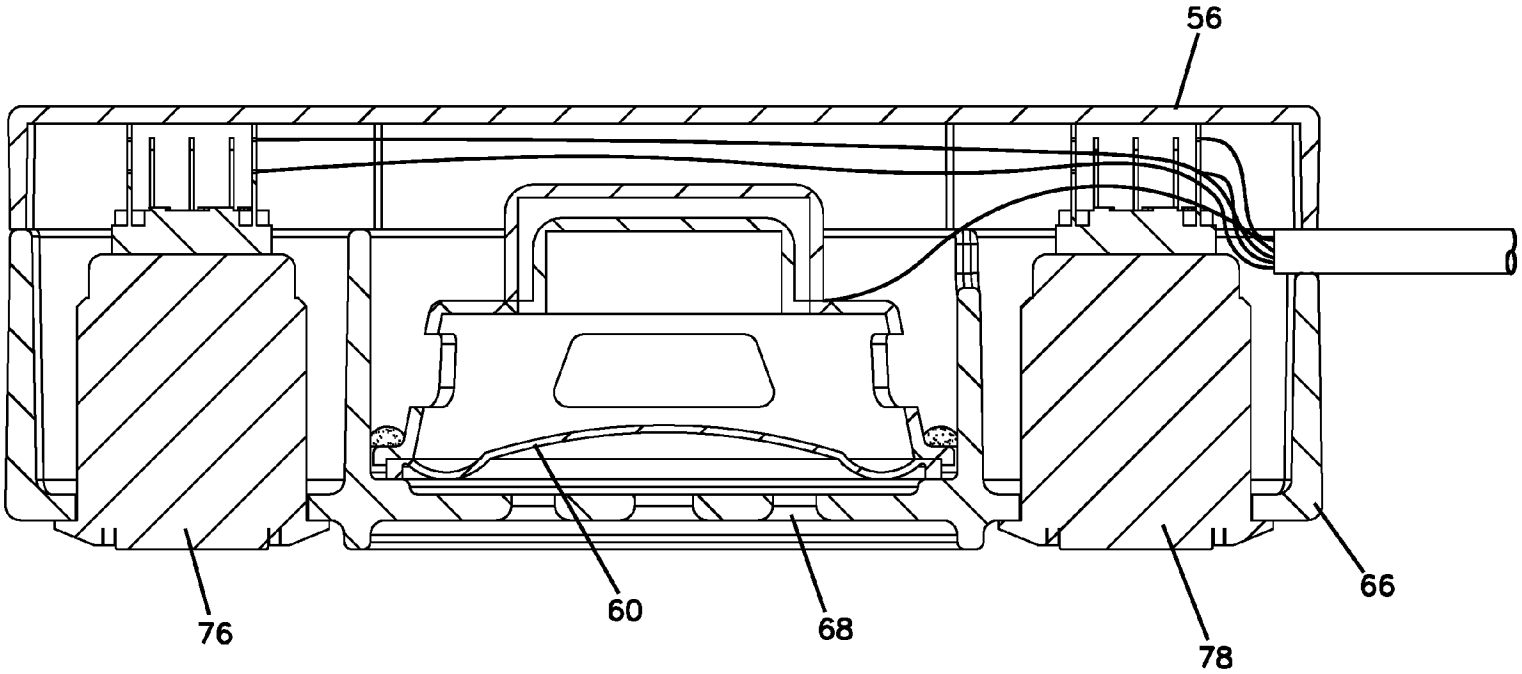
FIG. 17 is a perspective view of a portion of the component of FIG. 13.

Referring to the figures, the garment of the present disclosure is described in further detail. In the depicted embodiment, the garment 10 includes a body portion 80 that includes a back portion 12 and a front portion 20. The back portion 12 includes a rear upper shoulder portion 14 that includes a trapezoid covering portion 82 and a shoulder blade covering portion 84. The rear upper shoulder portion 14 includes a first layer 16 and a second layer 18. It should be appreciated that alternative configurations are possible.

In the depicted embodiment, the front portion 20 includes a front upper shoulder portion 22 that includes a collar bone covering portion 86. The front upper shoulder portion 22, 23 includes a first layer 24 and a second layer 26. In the depicted embodiment, the first layer 24 and second layers 26 are composite materials each including three sub layers. In the depicted embodiment, the front upper shoulder portions 22, 23 of the front portion 20 includes mesh openings 48, 50. In the depicted embodiment the first layer 24 and second layer 26 are flexible and stretch. It should be appreciated that many other alternative configurations are possible.

In the depicted embodiment, the garment 10 includes a first through channel 28 and a second through channel 30. The first and second through channels 28, 20 are provided between the front upper shoulder portion 22 of the front portion 20 and the rear upper shoulder portion 14 of the back portion 12 and also between the first layer 16 and second layer 18 of the back portion. In the depicted embodiment, the channels 28, 30 are also between the first layer 24 and the second layer 26 of the front upper shoulder portion 22. It should be appreciated that many other alternative configurations are also possible.

In the depicted embodiment, the garment 10 includes a left speaker enclosure 32 and a right speaker enclosure 34 provided in the front upper shoulder portion 22 of the front portion 20. In the depicted embodiment, the left and right speaker enclosures 32, 34 have at least a portion located between the first layer 26 and the second layer 26. In the depicted embodiment, the front face 52 of the left speaker enclosure 32 is located adjacent the mesh opening 48 and the front face 54 of the right speaker enclosure 34 is located adjacent the mesh opening 50. In the depicted embodiment, the left speaker enclosures 32, 34 are stitched between adjacent layers of the collar bone covering portion 86 of the front portion 20. It should be appreciated that many other alternative configurations are possible.

In the depicted embodiment, the left and right speaker enclosures 32, 34 include a waterproof construction. In the depicted embodiment, the left and right speaker enclosures include the same configuration. Accordingly, only the left speaker enclosure will be described in further detail herein.

In the depicted embodiment, the left speaker enclosure includes a body portion that includes a front face 52 and a rear face 56. The front face 52 including at least one aperture 58 therein that opens to a cone portion 60 of a speaker 62. In the depicted embodiment, the cone portion 60 of the speaker 62 is arranged such that liquid (e.g., water) that comes into contact with the cone portion 60 will naturally drain away from the cone when the garment is a vertical position (normal position when the garment is worn). In the depicted embodiment, the cone portion 60 is at least partially exposed to the environment. In the depicted embodiment, control buttons 76, 78 secure the left and the right speaker enclosure 32, 34. In the depicted embodiment, the control buttons 76, 78 are sealed to the speaker enclosure. It should be appreciated that alternative configurations are possible.

In the depicted embodiment, the aperture 58 is one of many apertures that are a part of a speaker protector/speaker guard 68. The speaker protector 68 is positioned over the cone portion 60 of the speaker (i.e., the cone portion 60 is positioned behind the perforated guard). In the depicted embodiment, the cone portion 60 is constructed of a waterproof material. The periphery edge 64 of the cone portion is sealed to a cylindrical sleeve 66 (internal tube) positioned within the left speaker enclosure 32. In the depicted embodiment, the cone portion 60 is located behind a perforated guard and sealed around its periphery from its back side within an internal tube 66. It should be appreciated that alternative configurations are possible.

In the depicted embodiment, the garment 10 includes a power and control box 36 provided in the rear upper shoulder portion 14 of the back portion 12 between the first layer 16 and the second layer 18. In the depicted embodiment, the power and control box 36 includes at least a battery 38, a control circuit 40, and an inductive charging coil 42. In the depicted embodiment, a charging unit 74 is provided that is configured to charge the battery 38 when the garment 10 is placed adjacent to the charging unit 74. It should be appreciated that many alternative configurations are also possible (e.g., alternative configuration may include a removable battery and/or a batter that is charged via a wired connection).

In the depicted embodiment, a plurality of closed cell foam pads 70 are stitched between the first layer 16 and second layer 16 of the back portion 12 and the first layer 24 and second layer 26 of the front portion 20. In the depicted embodiment, the power and control box 36 is nested within a foam pad 72. In the depicted embodiment, the power and control box 36 recessed within the shoulder blade covering portion 84 of the back portion 12. It should be appreciated that alternative configurations are possible.

In the depicted embodiment, the garment 10 includes a first wire 44 extending between the left speaker enclosure 32 to the power and control box 36. The first wire 44 extends through the first through channel 28. In the depicted embodiment, the garment 10 includes a second wire 46 extending between the right speaker enclosure 34 to the power and control box 36. The second wire 46 extends through the second through channel 30. In the depicted embodiment, a first set of control wires extend from the left speaker enclosure 32 located in the front covering portion to the power control box 36 located in the back covering portion and a second set of wires control wires extend from the right speaker enclosure 34 located in the front covering portion to the power control box 36 located in the back covering portion. In the depicted embodiment, the first set of control wires and the second set of control wires are free floating within the through channel 28, 30.

The present disclosure also provides a method of manufacturing a garment having integrated waterproof speakers. In the depicted embodiment, the method can include the step of cutting a first pattern from a first material to form an inside layer 100. The periphery edge of the inside layer can include a right closure edge 102, a front right neck edge 104, a right front shoulder edge 106, a right arm hole edge 108, a right rear shoulder edge 110, a rear neck edge 112, a left rear shoulder edge 114, a left arm hole edge 116, a left front shoulder edge 118, front left neck edge 120, and a left closure edge 122. The method can include the step of cutting a second pattern from a second material to form an outside layer 124. The periphery edge of the outside layer 124 matches the periphery of the inside later 100 and can include a right closure edge 126, a front right neck edge 128, a right front shoulder edge 130, a right arm hole edge 132, a right rear shoulder edge 134, a rear neck edge 136, a left rear shoulder edge 138, a left arm hole edge 140, a left front shoulder edge 142, front left neck edge 144, and a left closure edge 146. It should be appreciated that many alternative patterns are also possible.

The disclosed method can include the step of cutting apertures 148, 150 in a left shoulder zone 152 and right front shoulder zone 154 of the outside layer to create a left speaker outlet and a right speaker outlet. The method can also include the step of stitching mesh material 156, 158 over the left speaker outlet and the right speaker outlet. The method can also include the step of stitching a first zipper portion 160 between the inside layer 100 and outside layer 124 along the right closure edge 102, 126 and stitching a second zipper portion 162 between the inside layer 100 and outside layer 124 along the left closure edge 122, 146. It should be appreciated that many alternative steps are also possible.

The method can include the step of stitching a plurality of foam pads 164, 166, 168 between the inside layer 100 and outside layer 124. The method can include the step of stitching the right front shoulder edge 130 of the outside layer 124 to the right rear shoulder edge 134 of the outside layer 136. The method can include the step of stitching the right front shoulder edge 106 of the inside layer 100 to the right rear shoulder edge 110 of the inside layer 100 thereby creating a first shoulder channel 170. It should be appreciated that many alternative steps are also possible.

The method can include the step of electrically connecting a sealed left speaker enclosure 32 to a power and control box 36 via a first wire 44 and electrically connecting a sealed right speaker enclosure to the power and control box via a second wire 46. The method can include the step of placing the sealed left speaker enclosure 32 between the inside layer 100 and outside layer 124 such that the face of the left speaker enclosure is adjacent the left speaker outlet and placing the right speaker enclosure 34 between the inside layer 100 and outside layer 124 such that the face of the sealed right speaker enclosure is adjacent the right speaker outlet. It should be appreciated that many alternative steps are also possible.

The method can include the step of placing the power and control box 36 between the inside layer 100 and outside layer 124 below the rear neck edge 112, 136. The method can include the step of arranging the first wire 44 though the first shoulder channel 170 and arranging the second wire 46 through the second shoulder channel. It should be appreciated that many alternative steps are also possible.

The method can include the step of stitching the front right neck edge 104 of the inside layer 100 to the front right neck edge 128 of the outside layer 124, stitching the right arm hole edge 108 of the inside layer 100 to the right arm hole edge 132 of the outside layer 124, stitching the rear neck edge 112 of the inside layer 100 to the rear neck edge of the outside layer 124, stitching the left arm hole edge 116 of the inside layer 100 to the left arm hole edge 140 of the outside layer 124, stitching the front left neck edge 120 of the inside layer 100 to the front left neck edge 144 of the outside layer 124. It should be appreciated that many alternative steps are also possible.

The method can include the steps of assembling the sealed left speaker enclosure, wherein steps include: inserting a circular profile speaker 62 into a cylindrical tube structure/cylindrical sleeve 66. In the depicted embodiment, the tube structure is open to a front portion 52 of a speaker enclosure 32. The method can include the step of sealing the periphery of the speaker to cylindrical tube structure and melting a rear cap over the rear portion of the speaker enclosure to seal the speaker enclosure.

The method can also include the step of arranging a first set of wires though the first channel and arranging the second set of wires through a second channel and proving a first and second set of wires that are 150% the length of the distance between the left speaker and the power and control box.

Various modifications and alterations of this disclosure will become apparent to those skilled in the art without departing from the scope and spirit of this disclosure, and it should be understood that the scope of this disclosure is not to be unduly limited to the illustrative examples set forth herein.

We claim:

1. A garment comprising:

a back portion, the back portion including a rear upper shoulder portion, the rear upper shoulder portion including at least a first layer and a second layer;

a front portion, the front portion including a front upper shoulder portion, the front upper shoulder portion including at least a first layer and a second layer;

wherein at least a first through channel and a second through channel are provided between the first and second layers of the front and rear upper shoulder portion of the front portion and the back portion;

a left speaker enclosure and a right speaker enclosure provided in the front upper shoulder portion of the front portion, wherein the left and right speaker enclosures have at least a portion located between the first layer and the second layer, wherein the left and right speaker enclosure include a waterproof construction;

a power and control box provided in the rear upper shoulder portion of the back portion between the first layer and the second layer, the power and control box including at least a battery, a control circuit, and an inductive charging coil;

a first wire extending between the left speaker enclosure to the power and control box, wherein the first wire extends through the first through channel; and a second wire extending between the right speaker enclosure to the power and control box, wherein the second wire extends through the second through channel.

2. The garment of claim 1, the upper shoulder portions of the front portion includes mesh openings located adjacent a front face of the left speaker enclosure and the right speaker enclosure.

3. The garment of claim 1, wherein the left speaker enclosure includes a body portion that includes a front face and a rear face, the front face including at least one aperture therein that opens to a cone portion of a speaker, wherein the cone portion is constructed of a waterproof material, wherein the periphery edge of the cone portion is sealed a cylindrical sleeve positioned within the left speaker enclosure.

4. The garment of claim 1, wherein the cone of the speaker is arranged such that liquid that comes into contact with the cone will drain away from the cone portion when the garment is a vertical position.

5. The garment of claim 1, further comprising a plurality of closed cell foam pads stitched between the first layer and second layer of the back portion and the first layer and second layer of the front portion.

6. The garment of claim 1, wherein the power and control box is nested within a foam pad.

7. The garment of claim 1, wherein control buttons are secure to at least one of the left or right speaker enclosure.

8. The garment of claim 1, further comprising a charging unit that is configured to charge the battery when the garment is placed adjacent to the charging unit.

9. The garment of claim 1, wherein the left and right speaker enclosures have a speaker protector positioned over the cone portion of the speaker, wherein the speaker protector includes a plurality of apertures therein.

10. A watersports garment comprising:

a body portion including a front portion connected to a back portion, wherein the front portion includes a left collar bone covering portion, a right collar bone covering portion, and wherein the back portion includes a shoulder blade covering portion;

a first waterproof speaker unit stitched between adjacent layers of the left collar bone covering portion;

a second waterproof speaker unit stitched between adjacent layers of the right collar bone covering portion;

a power and control box recessed within the shoulder blade covering portion;

a first set of control wires extending between the first water proof speaker and the power and control box, wherein the first set of control wires extend from the front covering portion to the back covering portion between adjacent layers; and a second set of control wires extending between the second water proof speaker and the power and control box, wherein the second set of control wires extend from the front covering portion to the back covering portion between adjacent layers.

11. The watersports garment of claim 10, wherein the first set of control wires and the second set of control wires are free floating within a channel between the adjacent layers.

12. The watersports garment of claim 10, wherein the first waterproof speaker unit has a cone portion that is at least partially exposed to the environment located behind a perforated guard and sealed around its periphery within an internal tube.

13. The watersports garment of claim 10, wherein the first waterproof speaker unit supports a plurality of control buttons that are sealed to the speaker unit.

14. The watersports garment of claim 10, wherein the first waterproof speaker unit is stitched between layers of the garment and a mesh material is positioned over at least a portion of the front face of the speaker unit.

15. A method of manufacturing a garment having integrated waterproof speakers comprising:

cutting a first pattern from a first material to form an inside layer, wherein a periphery edge of the inside layer includes a right closure edge, a front right neck edge, a right front shoulder edge, a right arm hole edge, a right rear shoulder edge, a rear neck edge, a left rear shoulder edge, a left arm hole edge, a left front shoulder edge, front left neck edge, left closure edge;

cutting a second pattern from a second material to form an outside layer, wherein a periphery edge of the outside layer matches the periphery of the inside layer and includes a right closure edge, a front right neck edge, a right front shoulder edge, a right arm hole edge, a right rear shoulder edge, a rear neck edge, a left rear shoulder edge, a left arm hole edge, a left front shoulder edge, front left neck edge, left closure edge;

cutting apertures in the left and right front shoulder zones of the outside layer to create a left speaker outlet and a right speaker outlet;

stitching mesh material over the left speaker outlet and the right speaker outlet;

stitching a first zipper portion between the inside layer and outside layer along the right closure edge and stitching a second zipper portion between the inside layer and outside layer along the left closure edge;

stitching a plurality of foam pads between the inside layer and outside layer;

stitching the right front shoulder edge of the outside layer to the right rear shoulder edge of the outside layer;

stitching the right front shoulder edge of the inside layer to the right rear shoulder edge of the inside layer thereby creating a first shoulder channel;

electrically connecting a sealed left speaker enclosure to a power and control box via a first wire and electrically connecting a sealed right speaker enclosure to the power and control box via a second wire;

placing the sealed left speaker enclosure between the inside layer and outside layer such that the face of the left speaker enclosure is adjacent the left speaker outlet and placing the right speaker enclosure between the inside layer and outside layer such that the face of the sealed right speaker enclosure is adjacent the right speaker outlet;

placing the power and control box between the inside layer and outside layer below the rear neck edge;

arranging the first wire though the first shoulder channel and arranging the second wire through a second shoulder channel; and stitching the front right neck edge of the inside layer to the front right neck edge of the outside layer, stitching the right arm hole edge of the inside layer to the right arm hole edge of the outside layer, stitching the rear neck edge of the inside layer to the rear neck edge of the outside layer, stitching the left arm hole edge of the inside layer to the left arm hole edge of the outside layer, stitching the front left neck edge of the inside layer to the front left neck edge of the outside layer.

16. The method of claim 15, comprising the steps of assembling the sealed left speaker enclosure, wherein steps include:

inserting a circular profile speaker into a cylindrical tube structure, wherein the tube structure is open to a front portion of a speaker enclosure;

sealing the periphery of the speaker to cylindrical tube structure;

melting a rear cap over the rear portion of the speaker enclosure to seal the speaker enclosure.

17. The method of claim 15, wherein the step of arranging the first wire harness though the first channel and arranging the second wire harness through the second channel includes providing a first and second wire harness that is 150% the length of the distance between the left speaker and the power and control box.

* * * * *